US006203064B1

(12) United States Patent
Zaltron

(10) Patent No.: US 6,203,064 B1
(45) Date of Patent: Mar. 20, 2001

(54) POLE FOR SKIING AND TREKKING

(75) Inventor: Renato Zaltron, Romano d'Ezzelino (IT)

(73) Assignee: Masters S.r.l., Bassano del Grappa (IT)

( * ) Notice: Subject to any disclaimer, the term of this patent is extended or adjusted under 35 U.S.C. 154(b) by 0 days.

(21) Appl. No.: 09/165,290

(22) Filed: Oct. 2, 1998

(30) Foreign Application Priority Data

Oct. 3, 1997 (IT) ..... PD970067 U

(51) Int. Cl.[7] ..... A63C 11/24
(52) U.S. Cl. ..... 280/824; 403/349
(58) Field of Search ..... 280/809, 819, 280/822, 823, 824; 403/165, 349, 351, 361, 378

(56) References Cited

U.S. PATENT DOCUMENTS 1,818,261 * 8/1931 Koch et al. ..... 403/349
3,150,879 * 9/1964 Head ..... 280/824
3,825,275 * 7/1974 Klemm ..... 280/823
4,385,776 * 5/1983 Pronzati ..... 280/824
4,669,752 * 6/1987 Jackson et al. ..... 280/824
5,024,866 * 6/1991 Goode ..... 280/819
5,139,284 * 8/1992 Rönning et al. ..... 280/823

FOREIGN PATENT DOCUMENTS

2632201 * 1/1987 (DE) ..... 280/823
5-115588 * 5/1993 (JP) ..... 280/824
154852 * 4/1956 (SE) ..... 280/824
210587 * 11/1964 (SE) ..... 280/824

* cited by examiner

*Primary Examiner*—Frank Vanaman
(74) *Attorney, Agent, or Firm*—Sughrue, Mion, Zinn, Macpeak & Seas, PLLC

(57) ABSTRACT

The pole includes a shaft at one axial end of which a small basket is replaceably mounted by a removable bayonet-type attachment device which comprises a locking member capable of preventing relative rotation between the shaft and the basket once the latter is fixed to the shaft in the operating position.

4 Claims, 4 Drawing Sheets

POLE FOR SKIING AND TREKKING

BACKGROUND OF THE INVENTION

The subject of the present invention is an improved pole for skiing and trekking.

In the field mentioned above, poles are currently used, generally of the type with telescopic shaft, at the opposite end from the handle of which there is removably mounted a small basket. A typical technique for the mounting of the said basket is that of screw-threaded connection between the hub of the latter and the shaft of the pole.

This technique, however, has the drawback that the basket is potentially subject to unscrewing during use. Another known technique provides for the basket to be mounted on the shaft of the pole by means of a bayonet-type connection. Also in this case the basket is still potentially subject to loss, or the system for mounting it on the shaft is relatively complex.

SUMMARY OF THE INVENTION

The principal aim of the invention is that of providing an improved pole functionally and structurally designed so as to make it possible to overcome all the drawbacks involved with reference to the above-mentioned prior art. This aim is fulfilled by a pole produced in accordance with the claims which follow.

BRIEF DESCRIPTION OF THE DRAWINGS

The characteristics and advantages of the invention will become clear from the following detailed description of one of its preferred embodiments illustrated by way of non-limiting example with reference to the appended drawings, in which.

DETAILED DESCRIPTION OF THE INVENTION

Figure 2:
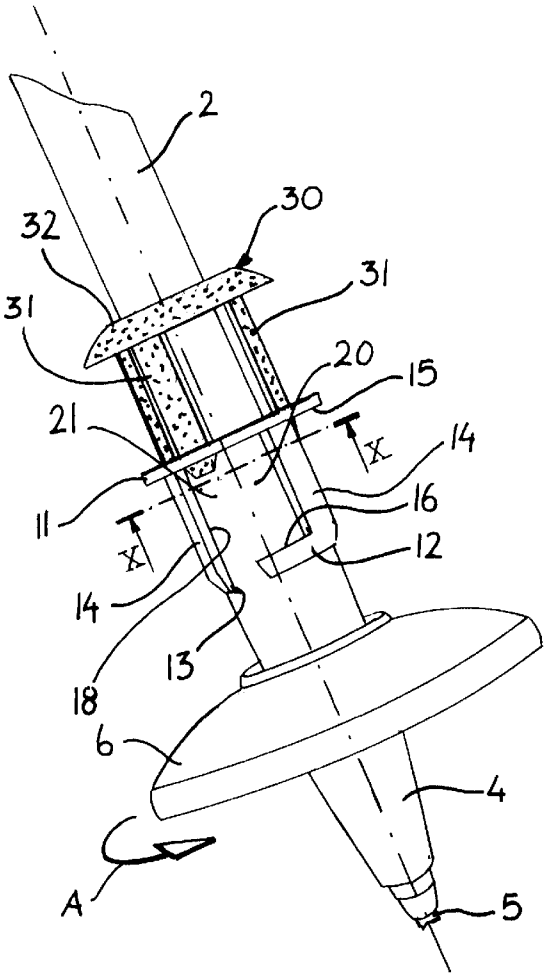
FIG. 2 is a perspective view in partial section of a detail of the pole in FIG. 1.
Figure 1:
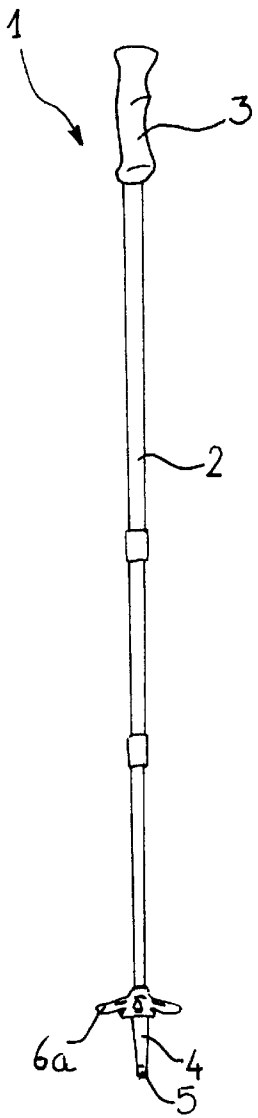
FIG. 1 is a diagrammatic view in side elevation of a pole according to the present invention.
Figure 3:
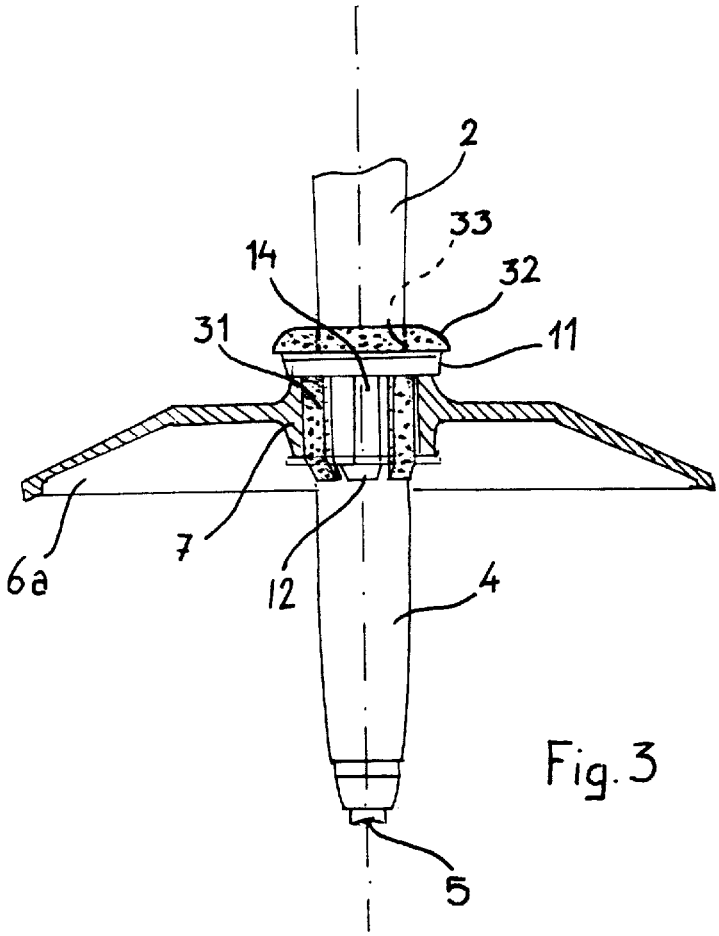
FIG. 3 is a view in front elevation and in partial section of the detail in FIG. 2, FIGS. 4 and 5 are plan views of two different baskets intended for equipping the pole of the invention.
Figure 10:
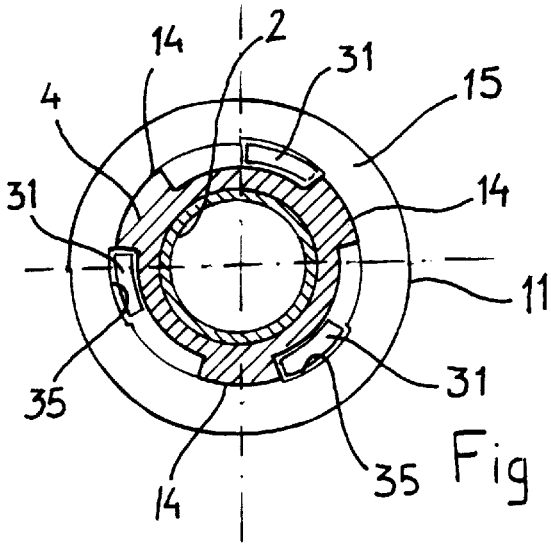
FIG. 10 is a sectional view on an enlarged scale along the line x—x in FIG. 2.
Figure 5:
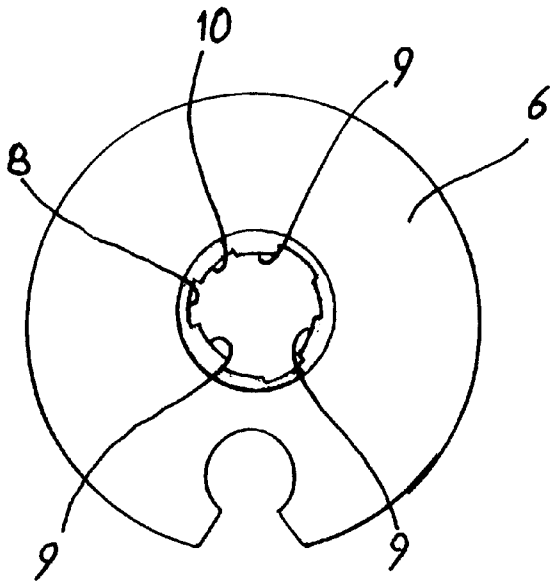
Figure 4:
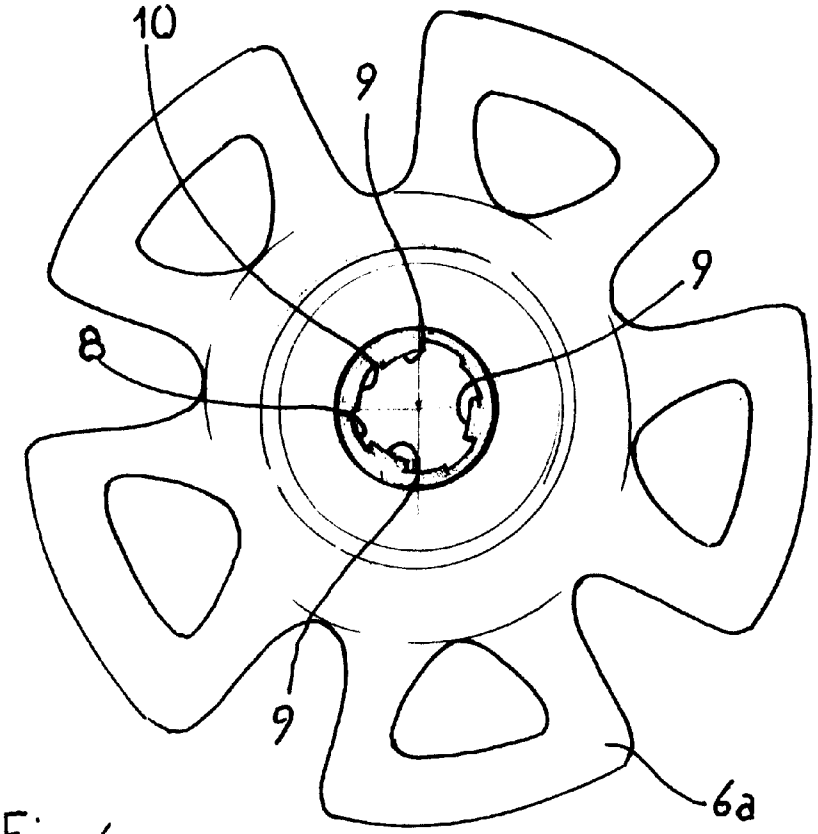

In the drawings, the reference 1 indicates as a whole an improved pole for skiing and trekking according to the present invention. The pole 1 comprises an axially elongate, telescopically adjustable shaft 2, at one axial end of which there is mounted a handle 3 and at the axially opposed end of which there is rigidly connected a tip 4, made of plastics material, which carries a spiked end stud 5 made of steel.

On the tip 4 there is removably secured a small basket 6 which is connected to the shaft 2 by way of a removable bayonet-type attachment device illustrated more fully in the following, in such a manner as to allow the substitution of the basket 6 by another basket **6*a*** of larger diameter, or the removal of both.

The basket 6 is provided centrally with a tubular hub 7 in which is provided a first grooved profile consisting of grooves 8 alternating with axial projections 9 with a uniformly spaced distribution. For the purposes of the invention, however, it is sufficient for at least one projection to be provided in order to obtain the desired bayonet-type connection, although a plurality of such projections produce a more stable connection. In their turn the grooves 8 have a section 10 of their base in slight relief, or with a slightly reduced diameter with respect to the remaining diameter of the said base.

On the tip 4 there is provided a second grooved profile comprised between a flange 11 and a circumferential ridge 12 with a profile interrupted at openings 13. The aforesaid grooved profiles are subject to reciprocal bayonet-type connection in order to secure the basket 6 axially to the shaft 2.

The second profile comprises a plurality of axially elongate projections 14 between a first shoulder 15 of the flange 11 and a second shoulder 16 of the ridge 12, the said shoulders being substantially parallel to, spaced from, and facing one another.

Between adjacent projections 14, grooves 18 are defined. It will be observed that the arrangement of the projections 9, 14 or of the grooves 8, 18 is such as to allow reciprocal connection, the circumferential width of the grooves 18 on the tip 4 being, however, appreciably greater than the corresponding circumferential width of the projections 9 of the basket 6 so that the basket 6, once inserted on the tip 4, can be rotated to a limited extent with respect thereto into an operating position for axial locking on the shaft 2.

It will be observed that, like the grooves 8, the grooves 18 also have a section 20 of their base in slight relief, or with a slightly increased diameter, with respect to the adjacent base section 21. Both the said sections are axially elongate and the section 21 is located at the respective opening 13 while the section 20 is located at the ridge 12 where this forms the shoulder 16.

Figures 6, 7, 8, 9:
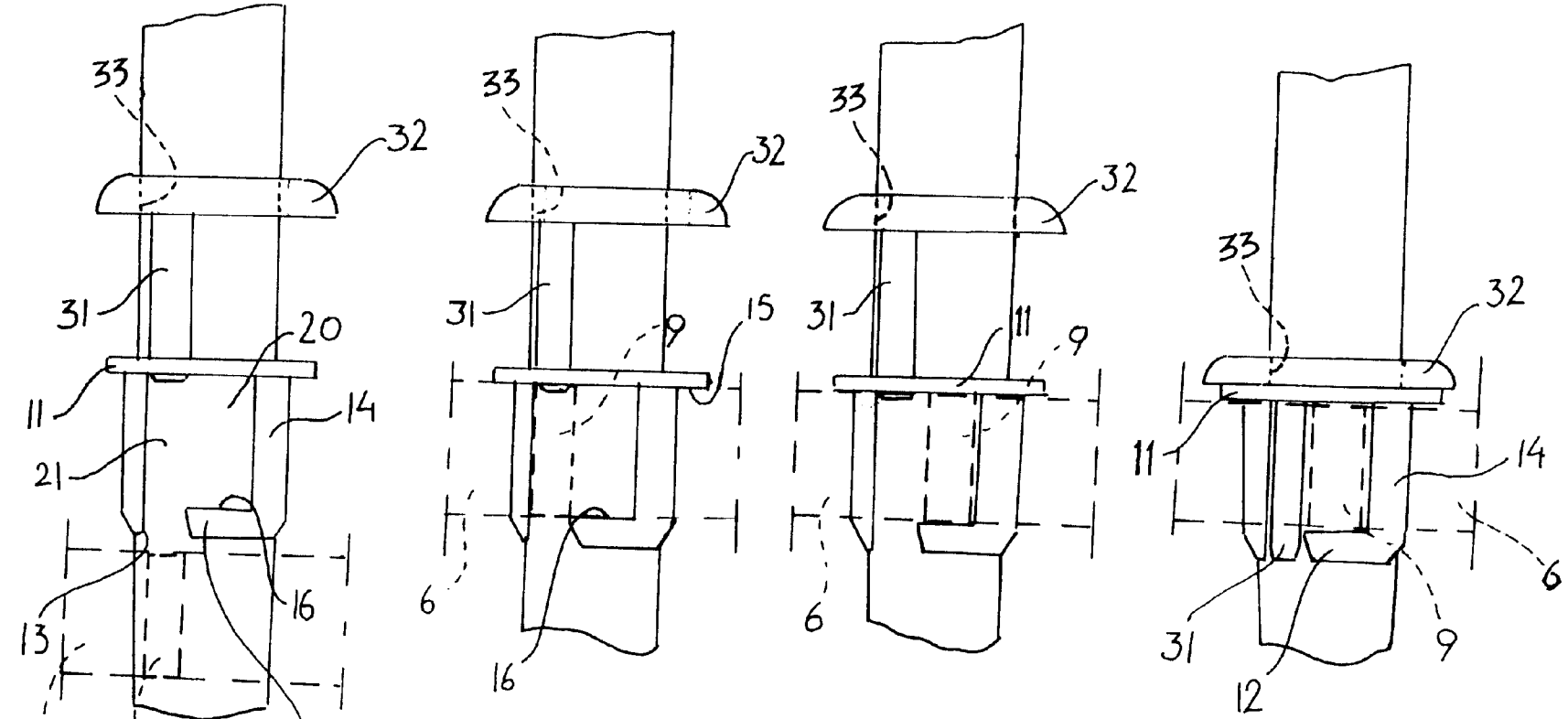
FIG. 6 is a diagrammatic view showing a first mounting step in the mounting a basket on the pole of the present invention.
FIG. 7 shows a second mounting step.
FIG. 8 shows a third mounting step.
FIG. 9 shows a fourth mounting step.

Locking means indicated as a whole by 30 are provided to complete the device for bayonet-type attachment between the basket and the shaft. The aforesaid locking means serve to prevent relative rotation between the basket and the tip once the basket is locked axially on the shaft between the shoulders 15, 16. They comprise one or more teeth 31 (in fact only a single tooth is necessary to perform the required locking function, but a solution with more teeth, advantageously equal in number to that of the grooves 18, is preferred) guided axially on the shaft 2 from and into an operating position (FIG. 9). The teeth 31 extend in the same direction from a flange 32 fitted coaxially on the shaft 2 above the tip 4 and the central bore 33 of which is of such dimensions that the said flange can perform a limited movement on the shaft 2 owing to the interference between the inside diameter of the bore 33 and the outside diameter of the shaft 2 itself, taking into account the conical shape of the latter (diameters increasing in a direction away from the tip).

Therefore the flange 32 is movable between a position in which the teeth 31 are completely withdrawn from the second grooved profile of the tip 4 and an operating position for locking the basket 6, wherein the aforesaid teeth 31 are inserted into the corresponding grooves of the two grooved profiles in reciprocal engagement, close to the corresponding projection 9 of the basket 6 in order to prevent its rotation in the direction of unlocking from the operating position.

The teeth 31 are likewise guided between openings 35 provided in the flange 32 of the tip 4 and remain engaged with their free end in said openings 35 also when the flange 32 is in the position furthest away from the flange 11 allowed by the interference between the bore 33 and the outside of the shaft 2.

In order to fit the basket 6 or 6*a* onto the tip 4, it is placed onto the latter coaxially, orientating it in such a way that the projections 9 are aligned with the corresponding openings 13 of the circumferential ridge 12 in such a manner as to allow their passage and the consequent engagement between the two grooved profiles of the bayonet-type connection.

Once the basket is butted with its own projections 9 against the shoulder 15 of the flange 11, the basket is rotated, in the direction of the arrow A, about its own axis until the projections 9 abut side by side the corresponding projections 14 of the second grooved profile. In so doing, the surface of the grooves 8 in the bore of the basket 6 are brought into engagement with the corresponding surfaces of the grooves 18 of the second grooved profile, producing a connection with slight interference which however helps to retain the basket 6, 6*a* in the angular position thus imparted thereto.

In this way, the basket 6 is locked axially along the shaft until it is rotated a second time, in the opposite direction to that of the arrow A. Such rotation can be prevented by moving the flange 32 into the position abutting the flange 11 in such a way that the teeth 31 are brought close to the projections of the grooved profile of the basket, locking it in rotation in the opposite direction to that of the arrow A. It will be noted that the slight interference which is created between the sections in slight relief respectively of the base of the grooves in the hub of the basket and of the base of the grooves in the grooved profile of the tip, themselves determine a limited loss-preventing locking of the basket which improves its security in use, in particular retaining the basket in the operating position until locking is completed by means of the device 30. In order to remove the basket 6, 6*a* it is sufficient to grip the flange 32 of the locking device and disengage the teeth 31 from the operating locking state defined above, rotate the basket in the opposite direction to that of the arrow A until the projections 9 are at the circumferential interruptions 13, and then disconnect the grooved profiles. It will be noted that, in order to facilitate and improve the identification of the locking device, the flange 32 and the teeth 31 rigidly connected thereto are obtained by pressing with a plastics material preferably of a different colour from that of the tip, thus obtaining an advantageous and pleasing coloured effect which adds value to the pole.

The invention thus fulfils the proposed aims and results in numerous advantages with respect to the solutions known at present, both in terms of improved reliability of the locking provided, and of the ease and immediacy of use and the relative economy of manufacture. Furthermore, the fact that temporary locking is however provided by interference between the basket and the tip renders the operations of substitution of the basket safe even in difficult or critical conditions.

What is claimed is:

1. A pole for skiing and trekking comprising an axially elongated shaft and a basket having an annular hub detachably mounted on said shaft adjacent one end of said shaft, wherein a bayonet connection is provided between said shaft and said basket, said bayonet connection comprising a first grooved profile disposed internally of said hub and having axially extending grooves alternating with axially extending radial projections and a second grooved profile on said shaft having axially extending grooves alternating with axially extending radial projections extending between axially spaced first and second shoulders on said shaft, said first shoulder closest to said one end of said shaft having circumferential interruptions aligned with respective grooves in said shaft to allow passage of corresponding radial projections on said hub into said grooves on said shaft upon axial movement of said hub toward said second shoulder on said shaft, said radial projections on said hub having an axial length less than a distance between said first and second shoulders on said shaft whereby upon movement of said radial projections on said hub into engagement with said second shoulder said hub may be rotated relative to said shaft to move said radial projections on said hub into engagement with said radial projections on said shaft between said first and second shoulders on said shaft and a locking member having an annular flange slidably mounted on said shaft above said second shoulder and having at least one axially extending tooth disposed in sliding engagement with said shaft in at least one opening in said second shoulder for axial movement internally of the hub of said basket into one of said grooves in said shaft adjacent said radial projection on the hub to prevent reverse rotation of said hub thereby locking said basket on said shaft.

2. A pole for skiing and trekking according to claim 1, wherein the at least one tooth has an axial length such that an end of the at least one tooth which is opposed to the flange is received at least partially in the corresponding circumferential interruption of the first shoulder when said flange engages said second shoulder.

3. A pole for skiing and trekking according to claim 1, wherein said shaft is conical and the annular flange of the locking member has an internal diameter which limits sliding movement of the annular flange away from said second shoulder whereby the at least one tooth on the flange will be retained in said at least one opening in said second shoulder.

4. A pole for skiing and trekking according to claim 1, wherein said one end of said shaft is made of plastics material.

* * * * *